US007665329B2

(12) United States Patent
Rankin et al.

(10) Patent No.: US 7,665,329 B2
(45) Date of Patent: Feb. 23, 2010

(54) CRYOGENIC AIR SEPARATION PROCESS WITH EXCESS TURBINE REFRIGERATION

(75) Inventors: Peter James Rankin, Williamsville, NY (US); Neil Mark Prosser, Lockport, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 12/272,193

(22) Filed: Nov. 17, 2008

(65) Prior Publication Data

US 2009/0071191 A1 Mar. 19, 2009

Related U.S. Application Data

(63) Continuation of application No. 11/265,123, filed on Nov. 3, 2005, now abandoned.

(51) Int. Cl.
*F25J 3/00* (2006.01)

(52) U.S. Cl. ..... 62/651; 62/650; 62/654

(58) Field of Classification Search ..... 62/654, 62/643, 646, 650, 651
See application file for complete search history.

(56) References Cited

U.S. PATENT DOCUMENTS

| | | | | |
|---|---|---|---|---|
| 3,236,059 | A * | 2/1966 | Bernstein | 62/643 |
| 5,463,870 | A * | 11/1995 | Rieth | 62/646 |
| 5,515,687 | A * | 5/1996 | Arriulou | 62/646 |
| 5,515,688 | A * | 5/1996 | Rieth | 62/646 |
| 5,765,397 | A * | 6/1998 | Honda et al. | 62/646 |
| 5,901,576 | A * | 5/1999 | Agrawal et al. | 62/646 |
| 6,430,962 | B2 * | 8/2002 | Miura et al. | 62/654 |

* cited by examiner

*Primary Examiner*—William C Doerrler
(74) *Attorney, Agent, or Firm*—David M. Rosenblum

(57) ABSTRACT

A process for carrying out cryogenic air separation wherein liquid oxygen is pressurized and vaporized against condensing feed air to produce oxygen gas product wherein excess plant refrigeration is generated such that the aggregate warm end temperature difference of the process exceeds the minimum internal temperature difference of the primary heat exchanger by at least 2K.

6 Claims, 3 Drawing Sheets

CRYOGENIC AIR SEPARATION PROCESS WITH EXCESS TURBINE REFRIGERATION

RELATED APPLICATIONS

This application is a continuation of U.S. patent application Ser. No. 11/265,123, filed Nov. 3, 2005 now abandoned.

TECHNICAL FIELD

This invention relates generally to cryogenic air separation and, more particularly, to cryogenic air separation to produce oxygen product.

BACKGROUND ART

The separation of air into its constituent components by distillation occurs at cryogenic temperatures, and requires some amount of refrigeration. This refrigeration is typically generated by the expansion of a process gas across a turbine. When designing air separation processes, the amount of refrigeration generated by expansion is typically kept at a minimum, as all forms of refrigeration generation are penal to the process, either by degrading the efficiency of the separation or by requiring more compression energy than is minimally required by the needs of the plant's distillation columns. The efficiency of refrigeration usage for a plant is reflected by the temperature difference between the streams entering and leaving the plant. This temperature difference is referred to as the aggregate warm end temperature difference (WEDT). At the extreme minimum, a WEDT of 0K indicates that only the refrigeration required to drive the air separation was generated.

In liquid oxygen pumped cryogenic air separation plants, product oxygen is removed as a liquid from the bottom of a low pressure distillation column, whereupon it is pumped to an elevated pressure, boiled in the primary heat exchanger or a product boiler against a condensing air stream, and the resulting vapor is superheated in the primary heat exchanger to form the gaseous oxygen product. If the liquid oxygen is pumped to its final delivery pressure, the gaseous oxygen product is sent directly to the end user, otherwise it requires further compression. The boiling of this oxygen against the condensing air gives rise to an internal pinch temperature difference. In other words, it gives rise to the minimum aggregate temperature difference between the cooling and warming streams in the primary heat exchanger (PHX). The magnitude of the PHX internal pinch is dictated by the available heat exchanger surface area. The larger the PHX, the tighter the pinch. Typically, in liquid oxygen pumped air separation plants, the PHX pinch DT is approximately 1-2K.

The condensing air stream has to be compressed to a higher pressure than that of the main air feed to the plant prior to entering the PHX. This compression is typically accomplished with a separate booster air compressor. The pressure of the condensing air stream is typically higher than that of the boiling oxygen stream. As such, when higher pressure oxygen is required as a product, the booster air compressor consumes a large amount of energy. Because of the rising energy costs, the need exists for improved cryogenic air separation processes that use less total energy. It is a goal of this invention to reduce total power consumption by reducing the compression requirements of the condensing air stream.

SUMMARY OF THE INVENTION

In a process for the cryogenic separation of feed air wherein feed air is cooled in a primary heat exchanger, is separated by cryogenic rectification in at least one column to produce oxygen-rich liquid and nitrogen-rich vapor, oxygen-rich liquid is increased in pressure, and the pressurized oxygen-rich liquid is vaporized by indirect heat exchange with at least some of the feed air to produce product oxygen, the improvement comprising generating sufficient excess refrigeration beyond that required to carry out the cryogenic rectification such that the aggregate warm end temperature difference of the process exceeds the minimum internal temperature difference of the primary heat exchanger by at least 2K.

As used herein, the term "aggregate warm end temperature difference" means the difference between the aggregate temperatures of those streams entering the primary heat exchanger and of those streams leaving the primary heat exchanger.

As used herein, the term "minimum internal temperature difference of the primary heat exchanger" means the smallest difference between the aggregate temperatures of the warming and cooling streams inside the primary heat exchanger.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*. A double column comprises a higher pressure column having its upper end in heat exchange relation with the lower end of a lower pressure column.

Vapor and liquid contacting separation processes depend on the difference in vapor pressures for the components. The higher vapor pressure (or more volatile or low boiling) component will tend to concentrate in the vapor phase whereas the lower vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the term "feed air" means a mixture comprising primarily oxygen and nitrogen, such as ambient air.

As used herein, the terms "upper portion" and "lower portion" of a column mean those sections of the column respectively above and below the mid point of the column.

As used herein, the terms "turboexpansion" and "turboexpander" mean respectively method and apparatus for the flow of high pressure fluid through a turbine to reduce the pressure and the temperature of the fluid, thereby generating refrigeration.

As used herein, the term "cryogenic air separation plant" means the column or columns wherein feed air is separated by cryogenic rectification to produce nitrogen, oxygen and/or argon, as well as interconnecting piping, valves, heat exchangers and the like.

As used herein, the term "compressor" means a machine that increases the pressure of a gas by the application of work.

DETAILED DESCRIPTION

In general the liquid oxygen pumped cryogenic air separation method of this invention is characterized by an aggregate warm end temperature difference (WEDT) that is at least 2K more than the primary heat exchanger's minimum internal temperature difference (PHX pinch DT). More preferably, the difference between the WEDT and the PHX pinch DT will be greater than 3K, and most preferably it is greater than 4K. The extra refrigeration required for this invention is generated by the expansion of a process gas across a turbine. In many cases the savings that will be realized by reducing the compression energy of the condensing air stream will more than offset the penalties associated with extra refrigeration production. This is particularly the case at higher oxygen boiling pressures.

Figure 1:
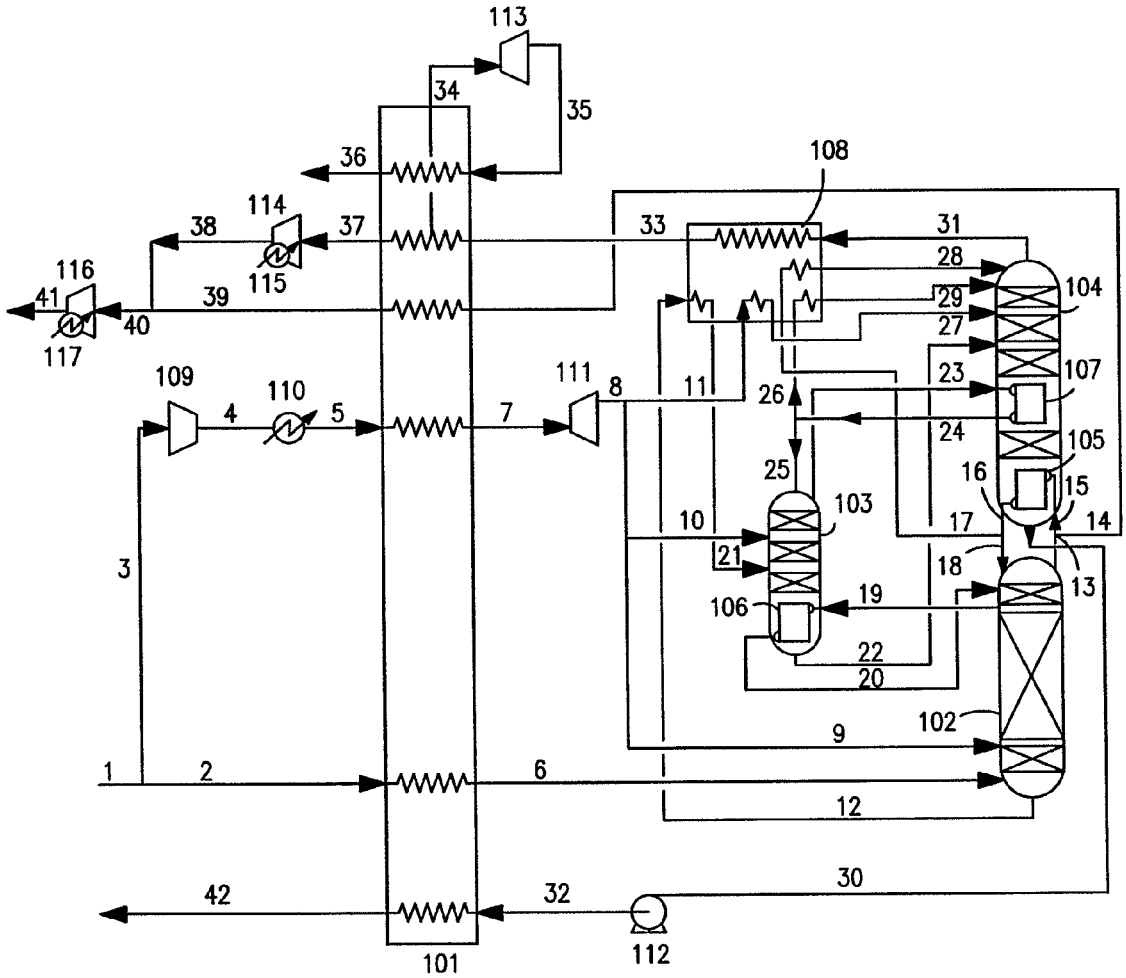
FIG. 1 is a schematic representation of one cryogenic air separation process which may be used with, and which can benefit by the application of, the process of this invention.

The invention will be described in greater detail with reference to the Drawings. Referring now to FIG. 1, compressed, chilled, pre-purified feed air 1, which has been compressed in a main air compressor, is split into two streams; stream 2 enters the warm end of primary heat exchanger 101 and stream 3 enters booster compressor 109. In booster compressor 109, this portion of the feed air is elevated to a pressure sufficiently high for it to condense against boiling oxygen product. High pressure air stream 4 passes through cooler 110 and cooled high pressure air stream 5 enters the warm end of the primary heat exchanger. Medium pressure air 6 exits heat exchanger 101 cooled to near the dew point. The cold air 6 then enters the bottom of higher pressure rectification column 102 which forms a double column along with lower pressure column 104. The high pressure air stream 5 is liquefied in the primary heat exchanger against boiling high pressure oxygen and exits the primary heat exchanger as a subcooled liquid. Subcooled liquid air stream 7 is expanded across liquid turbine 111 to provide a portion of the refrigeration needs of cryogenic air separation plant. The liquid air stream is expanded to approximately the operating pressure of column 102. Liquid air stream 8 is split into three streams; stream 9 enters column 102 a few stages above that point at which stream 6 enters the column, stream 10 is fed to intermediate pressure column 103 a number of stages from the bottom, and stream 11 is fed to heat exchanger 108. In heat exchanger 108, stream 11 is further cooled against warming nitrogen vapor, whereupon subcooled liquid air stream 27 is fed to low pressure column 104 a number of stages from the top.

In column 102, the air is separated into oxygen-enriched and nitrogen-enriched portions. Oxygen-enriched liquid 12 is removed from the bottom of the column, introduced into heat exchanger 108, cooled against warming nitrogen vapor, exits as a subcooled liquid 21, and is fed to an intermediate point of column 103, below the feed point for stream 10 but above the bottom of the column. Nitrogen vapor 13 exits the top of the medium pressure column 102. A portion of that vapor stream 14 is removed as medium pressure nitrogen product, and is fed to the cold end of primary heat exchanger 101. Stream 14 is warmed in primary heat exchanger 101 against cooling air streams and leaves at the warm end as warmed medium pressure nitrogen stream 39. The remaining portion 15 of stream 13 enters the condensing side of condenser/reboiler 105. Stream 15 is liquefied against vaporizing bottoms liquid in column 104. Liquid nitrogen 16 leaving condenser/reboiler 105 is split into two streams; stream 17 is sent to heat exchanger 108 and stream 18 is returned to column 102 as reflux. Stream 17 is subcooled against warming nitrogen vapor and resulting subcooled liquid nitrogen stream 28 enters low pressure column 104 at or near the top. A nitrogen enriched vapor stream 19 is removed at least one stage below the top of column 102 and enters the condensing side of condenser/reboiler 106. Stream 19 is liquefied against vaporizing bottoms liquid in column 103 and is returned to column 102 as liquid stream 20. Stream 20 enters column 102 at or above the withdrawal point for stream 19.

The intermediate pressure column 103 is used to further supplement the nitrogen reflux sent to low pressure column 104. Nitrogen vapor 23 exits the top of the intermediate pressure column 103 and enters the condensing side of condenser/reboiler 107. Stream 23 is liquefied against vaporizing liquid in the middle of column 104. Liquid nitrogen 24 leaving condenser/reboiler 107 is split into two streams; stream 25 is returned to the top of column 103 and stream 26 is fed to heat exchanger 108. Stream 26 is subcooled against warming nitrogen vapor and resulting subcooled liquid nitrogen stream 29 is fed at or near the top of low pressure column 104. Oxygen-enriched liquid 22 is removed from the bottom of column 103 and is fed to an intermediate point of low pressure distillation column 104, a number of stages above condenser/reboiler 107.

The low pressure distillation column 104 further separates its feed streams into oxygen-rich liquid and nitrogen-rich vapor. An oxygen-rich liquid stream 30 is removed from the lower portion of column 104, passed to cryogenic oxygen pump 112 and raised to slightly above the final oxygen delivery pressure. High pressure liquid stream 32 is fed to the cold end of primary heat exchanger 101 where it is warmed and boiled against the condensing high pressure feed air stream. Warmed, high pressure oxygen vapor product 42 exits the warm end of primary heat exchanger 101. Nitrogen-rich vapor 31 exits the upper portion of the low pressure column 104, is fed to heat exchanger 108, is warmed against cooling liquids, and leaves as superheated nitrogen vapor stream 33.

Stream 33 enters the cold end of primary heat exchanger 101 where it is partially warmed against cooling air streams and is split into two streams. The portion of this stream not needed to complete the nitrogen product requirement is removed from an intermediate point of primary heat exchanger 101, and this stream 34 is fed to waste turbine 113 and expanded to a lower pressure. Along with liquid turbine 111, waste turbine 113 is used to generate the cryogenic air separation plant's refrigeration. Low pressure nitrogen stream 35 exits waste turbine 113, is fed to primary heat exchanger 101, and leaves the warm end as warmed, low pressure waste nitrogen 36. Stream 37 leaves the warm end of heat exchanger 101 as warmed, low pressure product nitrogen and is fed to the first stages of the nitrogen compressor 114 and cooled in those stages' intercoolers 115. Cooled compressed nitrogen stream 38 is mixed with nitrogen stream 39, which is at the same pressure to form stream 40. Nitrogen stream 40 is fed to the remaining stages of the nitrogen compressor 116 and cooled in those stages' intercoolers 117. The resulting high pressure nitrogen stream is cooled (aftercooler not shown) to form product nitrogen stream 41 delivered to the end user.

For this given example, the required oxygen delivery pressure is 1115 pounds per square inch absolute (psia) and the required nitrogen delivery pressure is 335 psia. Ideally, the high pressure air stream 5 would be elevated to at least 2300 psia to accommodate the oxygen boiling above 1115 psia. There are limitations, however, to the pressures that can be tolerated by a brazed aluminum heat exchanger (BAHX). In this case we have limited stream 5 to a pressure of 1215 psia based on the economics and pressure limitations of the BAHX. Somewhat higher pressures are possible for a BAHX, but may not be economical. An alternative technology, such as spiral wound heat exchangers, would be required to handle stream pressures of 2300 psia. However, this is very expensive.

By the conventional paradigm, power is minimized when the upper column pressure is raised just enough that expansion of all the waste nitrogen provides the desired primary heat exchanger warm end temperature difference. If the pressure is raised higher than this, the waste expander would provide more than the needed refrigeration. When waste expansion is employed according to the conventional paradigm, the pressure of column 102 is only about 95 psia and the pressure of column 104 is about 25 psia.

Figure 2:
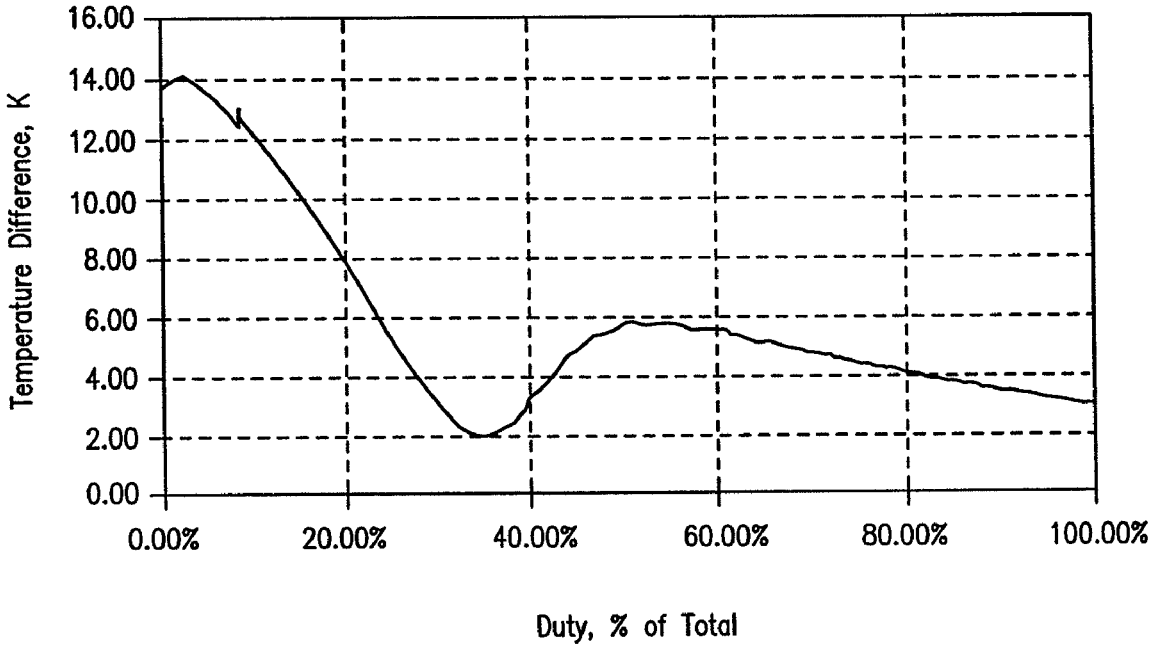
FIG. 2 is a graphical representation of the temperature difference between the composite warm and cold streams in the primary heat exchanger of the process illustrated in FIG. 1 as a function of heat exchanger duty when the process is carried out with conventional practice.

Because of the high boiling pressure of the oxygen in the primary heat exchanger and the ceiling placed upon the allowable pressure of the condensing high pressure air stream, a significant portion of the feed to the plant must enter booster compressor 109. In this example, the flowrate of stream 5 is approximately 35% that of stream 1. This high flowrate coupled with the high discharge pressure means that booster compressor 109 is responsible for a large portion of the plant's total energy consumption. In this case, over 25% of the plant's energy consumption comes from booster compressor 109. FIG. 2 shows the primary heat exchanger's cooling curve for the system with the pressure minimized such that the waste nitrogen expander refrigeration gives a primary heat exchanger temperature difference (WEDT) of 3.0K. The internal pinch (PHX pinch DT) of 2.0K is due to the warming of the supercritical (1115 psia) oxygen against cooling supercritical air (1215 psia). The substantial high pressure air flow provides an excess of refrigeration at the cold end of the primary heat exchanger, as evidenced by the large temperature difference at the cold end. The difference between the WEDT and the PHX pinch DT is 1.0K.

Figure 3:
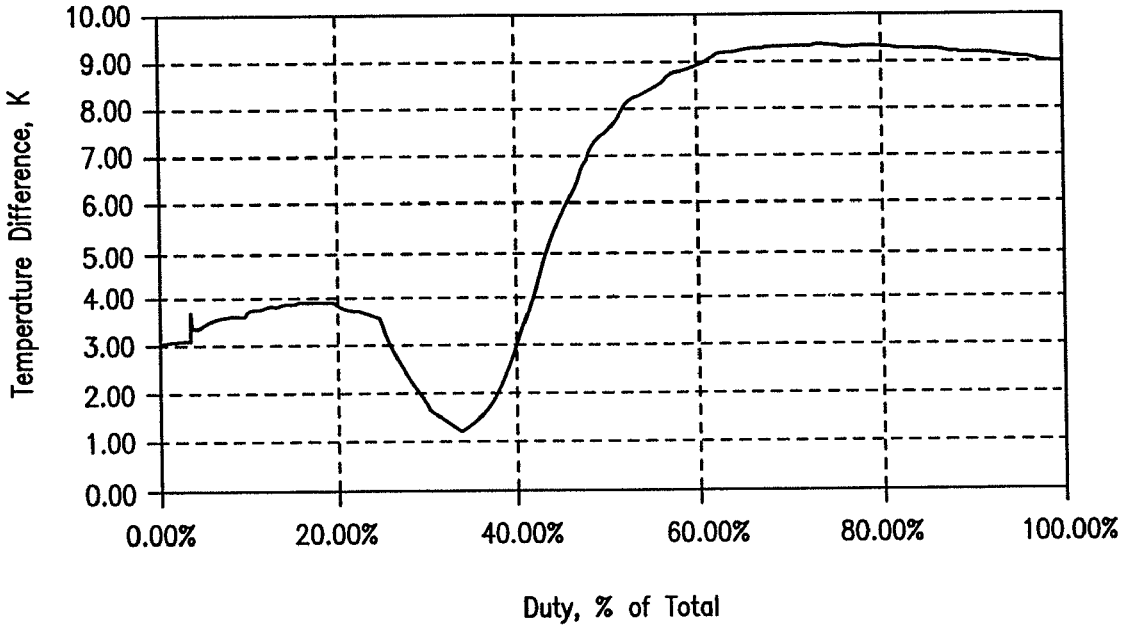
FIG. 3 is a graphical representation of the temperature difference between the composite warm and cold streams in the primary heat exchanger of the plant and process illustrated in FIG. 1 as a function of heat exchanger duty when the process is carried out with the practice of this invention.

The invention is applied to this cycle by elevating the pressure of the entire plant. When the pressure of column 102 is raised from 95 psia to 180 psia and the pressure of column 104 is raised from 25 psia to 57 psia, excess refrigeration is generated by the waste expansion turbine since all the nitrogen not needed as product is still passed through the waste expander. As a result, the cooling curve for the PHX opens considerably as is illustrated in FIG. 3. The difference between the WEDT and the PHX pinch DT is now greater than 7K. The result is that for the same primary heat exchanger 101, much less high pressure air 5 from the booster air compressor 109 is needed to properly boil all of the high pressure oxygen. With this excess refrigeration, the flowrate of stream 5 falls from 35% to 25% of feed stream 1 and the fraction of the plant's energy consumed by booster compressor 109 falls from 25% to 12.5%. Another benefit of the application of the invention to this cycle is a significant increase in the generated turbine power that would be realized from waste expansion turbine 113. Additionally, because the pressure of the entire plant is elevated in order to generate the excess refrigeration, nitrogen product streams 37 and 39 exit the plant at higher pressures, and thereby the power requirements of the nitrogen compressor fall.

In this specific example, there is also a very substantial capital cost benefit realized by the application of the invention. By preferentially operating the plant at elevated pressures, the sizes of the plant's pieces of equipment are allowed to be much smaller, thereby avoiding the need to construct two separate air separation unit trains, as would likely be required for such a large capacity plant operating at low pressures. Among the pieces of equipment that can be made smaller by this elevated pressure operation are all of the BAHX's, distillation columns, and pipes, as well as the plant's prepurifier. Additionally, operating the plant at an elevated pressure affords efficient, direct integration with the gas turbine air compressor (GTAC); operating the plant at elevated pressures allows for the optimal usage of the GTAC's extraction air.

Despite the higher power requirement of the main feed air compressor, the practice of this invention provides advantages over conventional practice. This is demonstrated in Table 1 which shows normalized power consumption for the cycle illustrated in FIG. 1 for conventional practice (A) and with the practice of this invention (B). The numerals in Table 1 refer to those of FIG. 1. In this example, which is presented for illustrative and comparative purposes and is not intended to be limiting, oxygen product stream 42 leaves the plant at 1115 psia and nitrogen product stream 41 is compressed to 335 psia. Additionally the practice of this invention allows for the efficient production of a modest amount of liquid product. Some of the excess turbine refrigeration can be used to make liquid product and the unit power associated with doing so would be very low.

TABLE 1

| | A | B | Improvement (Normalized % |
|---|---|---|---|
| Main Air Compressor | 554 | 694 | −14.1% |
| Booster Air Compressor 109 | 253 | 122 | 13.2% |
| Nitrogen Compressor 39 + 43 | 195 | 167 | 2.8% |
| Oxygen Pump 112 | 6 | 6 | 0.0% |
| Liquid Turbine 111 | −7 | −4 | −0.3% |
| Waste Expansion Turbine 113 | −2 | −22 | 2.0% |
| | 1000 | 964 | 3.6% |

The benefits of the practice of this invention will be particularly beneficial when the pressure of the oxygen product is at least 250 psia. Typically with the practice of this invention, the pressure of the oxygen product will be within the range of from 200 to 1500 psia.

Although the invention has been described in detail with reference to a certain embodiment and with reference to a certain cryogenic air separation cycle, those skilled in the art will recognize that there are other embodiments of the invention and other cryogenic air separation cycles within the spirit and the scope of the claims.

The invention claimed is:

1. In a process for the cryogenic separation of feed air wherein feed air is compressed, is cooled in a primary heat exchanger, is separated by cryogenic rectification in at least one column to produce oxygen-rich liquid and nitrogen-rich vapor, refrigeration is generated by passing part of the nitrogen-rich vapor through a turbine, oxygen-rich liquid is increased in pressure, and the pressurized oxygen-rich liquid is vaporized within the primary heat exchanger by indirect heat exchange with a portion of the feed air that is further compressed to produce product oxygen, the improvement comprising generating sufficient excess refrigeration beyond that required to carry out the cryogenic rectification such that the aggregate warm end temperature difference of the process exceeds the minimum internal temperature difference of the primary heat exchanger by at least 2K, the oxygen-rich liquid is vaporized within the primary heat exchanger at an expenditure of compression energy that is lower than that required for the vaporizing of the oxygen-rich liquid without the excess refrigeration and a power consumption of the process, as calculated by subtracting power generated by the turbine from a sum of energy consumed in compressing the air and in further compression of the portion of the feed air, is lower than the power consumption of the process without the excess refrigeration.

2. The process of claim 1 wherein after passage through the primary heat exchanger, the portion of the feed air that has been further compressed, undergoes turboexpansion.

3. The process of claim 1 wherein the aggregate warm end temperature difference exceeds the minimum internal temperature difference by at least 3K.

4. The process of claim 1 wherein the aggregate warm end temperature difference exceeds the minimum internal temperature difference by at least 4K.

5. The process of claim 1 wherein the oxygen product has a pressure of at least 200 psia.

6. The process of claim 1 further comprising recovering nitrogen-rich vapor as product nitrogen.

* * * * *